US007249929B2

(12) United States Patent
Cummings et al.

(10) Patent No.: US 7,249,929 B2
(45) Date of Patent: Jul. 31, 2007

(54) BLEED HOUSING

(75) Inventors: Kevin J. Cummings, West Hartford, CT (US); Christopher G. Demers, Willington, CT (US); James C. Hodgson, Canton, CT (US); Gabriel Suciu, Glastonbury, CT (US); Brian Merry, Andover, CT (US)

(73) Assignee: United Technologies Corporation, Hartford, CT (US)

( * ) Notice: Subject to any disclaimer, the term of this patent is extended or adjusted under 35 U.S.C. 154(b) by 53 days.

(21) Appl. No.: 10/713,641

(22) Filed: Nov. 13, 2003

(65) Prior Publication Data

US 2005/0106009 A1 May 19, 2005

(51) Int. Cl.
*F01D 25/14* (2006.01)

(52) U.S. Cl. ..... 415/144; 415/145; 415/211.2; 29/889.22

(58) Field of Classification Search ..... 415/144–145, 415/28, 209.2–209.4, 211.2; 60/785, 226.1, 60/226.3; 29/889.2, 889.21, 889.22
See application file for complete search history.

(56) References Cited

U.S. PATENT DOCUMENTS

| | | | | |
|---|---|---|---|---|
| 4,827,713 | A * | 5/1989 | Peterson et al. | 60/226.1 |
| 6,092,987 | A | 7/2000 | Honda et al. | |
| 6,755,025 | B2 * | 6/2004 | Eleftheriou et al. | 60/795 |
| 6,802,691 | B2 * | 10/2004 | Chlus | 415/145 |
| 2005/0008486 | A1 * | 1/2005 | Malmborg | 415/209.4 |

* cited by examiner

*Primary Examiner*—Ninh H. Nguyen
(74) *Attorney, Agent, or Firm*—Bachman & LaPointe, P.C.

(57) ABSTRACT

A gas turbine engine compressor has a number of shroud rings, at least a bleed one of which defines a number of bleed ports. A structural hub is downstream of the shroud rings and secured relative to the shroud rings. A structural hub case extends from an aft joint with the structural hub to a fore joint with a joined one of the shroud rings and has a number of valve ports. At least a portion of the structural case extends structurally between the fore and aft joints. A valve element is shiftable between first and second conditions for respectively blocking and not blocking communication through the valve ports.

19 Claims, 2 Drawing Sheets

BLEED HOUSING

BACKGROUND OF THE INVENTION (1) Field of the Invention

The invention relates to turbomachinery. More particularly, the invention relates to gas turbine engines having compressor bleeds.

(2) Description of the Related Art

Axial flow gas turbine engines include a compressor, a combustor and a turbine. A core flowpath for medium gases extends through these portions of the engine. During operation, the gases are pressurized in the compressor and fuel is added in the combustor. The fuel is burned to add energy to the pressurized gases. The hot, pressurized gases are expanded through the turbine to provide the work of hot, high pressure gases for subsequent use. Common gas turbine engine configurations divide the combustor and turbine into high and low speed/pressure sections whose blades are mounted on respective high and low speed spools. Additionally, a broad spectrum of turbine engines provide a bypass wherein the turbine (typically the low speed section) drives a fan which, in turn, propels gas along a flowpath bypassing the core flowpath.

Under certain conditions, air is bled from a compressor section for one or more purposes. The air may be bled for use such as in cooling. Alternatively, however, the air may be bled to reduce the load on the associated turbine section under certain operating conditions. An exemplary such operating condition is a transient startup condition. Such load-reducing bleeds may be controlled by a bleed valve. U.S. Pat. No. 6,092,987 of Honda et al., the disclosure which is incorporated by reference herein, discloses a stator assembly having a valve ring moveable between first and second conditions in which the ring respectively blocks and opens communication through bleed openings in a stator housing. Shifting between the first and second conditions is via a combination of rotation and longitudinal translation so as to provide a mechanical advantage. Nevertheless, there remains room for further improvement in bleed valve technology.

SUMMARY OF THE INVENTION

Accordingly, one aspect of the invention involves a gas turbine engine having a fan and a compressor. The compressor is along a core flowpath and has a number of rows of blades, a number of rows of vanes, and a number of shroud rings. At least a bleed one of the shroud rings defines a number of bleed ports. A structural hub is downstream of the shroud rings and is secured relative to the shroud rings. A structural case extends from an aft joint with the structural hub to a fore joint with a joined one of the shroud rings. The structural case has a number of valve ports. At least a portion of the structural case extends structurally between fore and aft joints. A valve element is shiftable between first and second conditions. In the first condition the valve element blocks communication through the valve ports. In the second condition the valve element does not block that communication.

In various implementations, the joined one of the shroud rings may not be the bleed one of the shroud rings. The bleed one of the shroud rings may comprise a shroud ring of an exit guide vane assembly and a bleed duct. The exit guide vane assembly may have a number of duct portions associated with aft portions of the bleed ports. The bleed duct may have a number of duct portions associated with fore portions of the bleed ports. The joined one of the shroud rings may be immediately upstream of the bleed one of the shroud rings. The valve element may be so shiftable via a combined circumferential rotation and longitudinal translation. The valve element may carry an outboard aft seal and an inboard fore seal for sealing with the structural case in the first condition. A bleed flowpath through the bleed ports and the valve ports may further extend through the structural hub to join a fan bypass flow. The structural hub may contain at least one fan exit guide vane. The bleed flowpath may join a fan bypass flow downstream of the fan exit guide vane.

Another aspect of the invention involves a gas turbine engine wherein a structural case extends from an aft joint with a structural hub to a fore joint with a joined one of a number of shroud rings. The structural case may have a number of valve ports. At least a portion of the structural case may extend as a continuous piece between the fore and aft joints.

In various implementations, the joined one of the shroud rings may be immediately upstream of a bleed one of the shroud rings. The structural hub may carry a number of fan exit guide vanes.

Another aspect of the invention involves a method for assembling a gas turbine engine. The method involves assembling an exit guide vane assembly including an aftmost of a number of shroud rings to a structural hub. A structural case is assembled to the structural hub. An assembly of the shroud rings is assembled to the structural case with at least one of the shroud rings being at least partially inserted within the structural case.

In various implementations, at least one fan exit guide vane may be preassembled with the structural hub. The aftmost of the shroud rings may have a number of duct portions associated with aft portions of the bleed ports. A penultimate shroud ring may have a number of duct portions associated with fore portions of the bleed ports. The valve element may be assembled to the structural case after the structural case is assembled to the structural hub.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
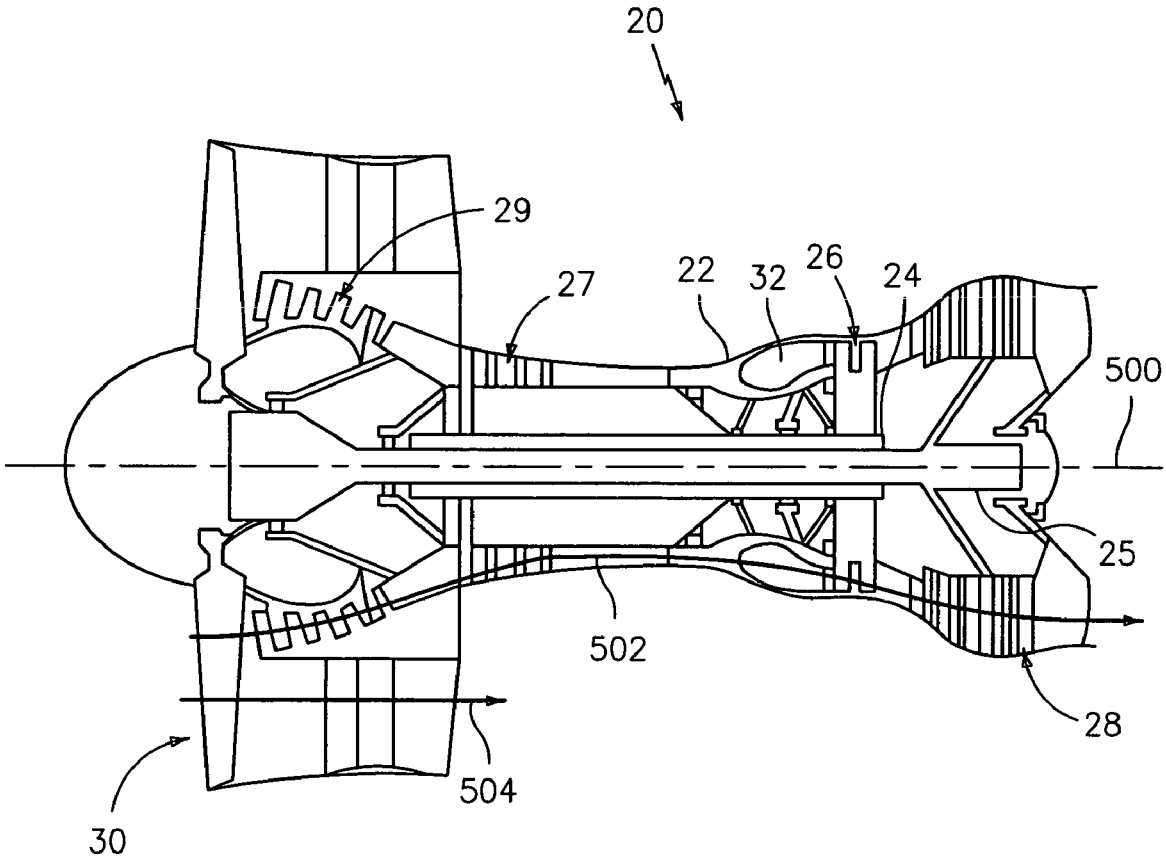
FIG. 1 is a longitudinal radial sectional view of a gas turbine engine according to the principles of the inventions.

FIG. 1 shows a gas turbine engine 20 having a case assembly 22 containing concentric high and low pressure rotor shafts 24 and 25. The shafts are mounted within the case for rotation about an axis 500 which is normally coincident with central longitudinal axes of the case and shafts. The high pressure rotor shaft 24 is driven by the blades of a high pressure turbine section 26 to in turn drive the blades of a high pressure compressor 27. The low pressure rotor shaft 25 is driven by the blades of a low pressure turbine section 28 to in turn drive the blades of a low pressure compressor section 29 and a fan 30. Air passes through the engine along a core flowpath 502 sequentially compressed by the low and high compressor sections 29 and 27, then passing through a combustor 32 wherein a portion of the air is combusted along with a fuel, and then passing through the high and low turbine sections 26 and 28 where work is extracted. Additional air is driven by the fan along a bypass flowpath 504.

Figure 2:
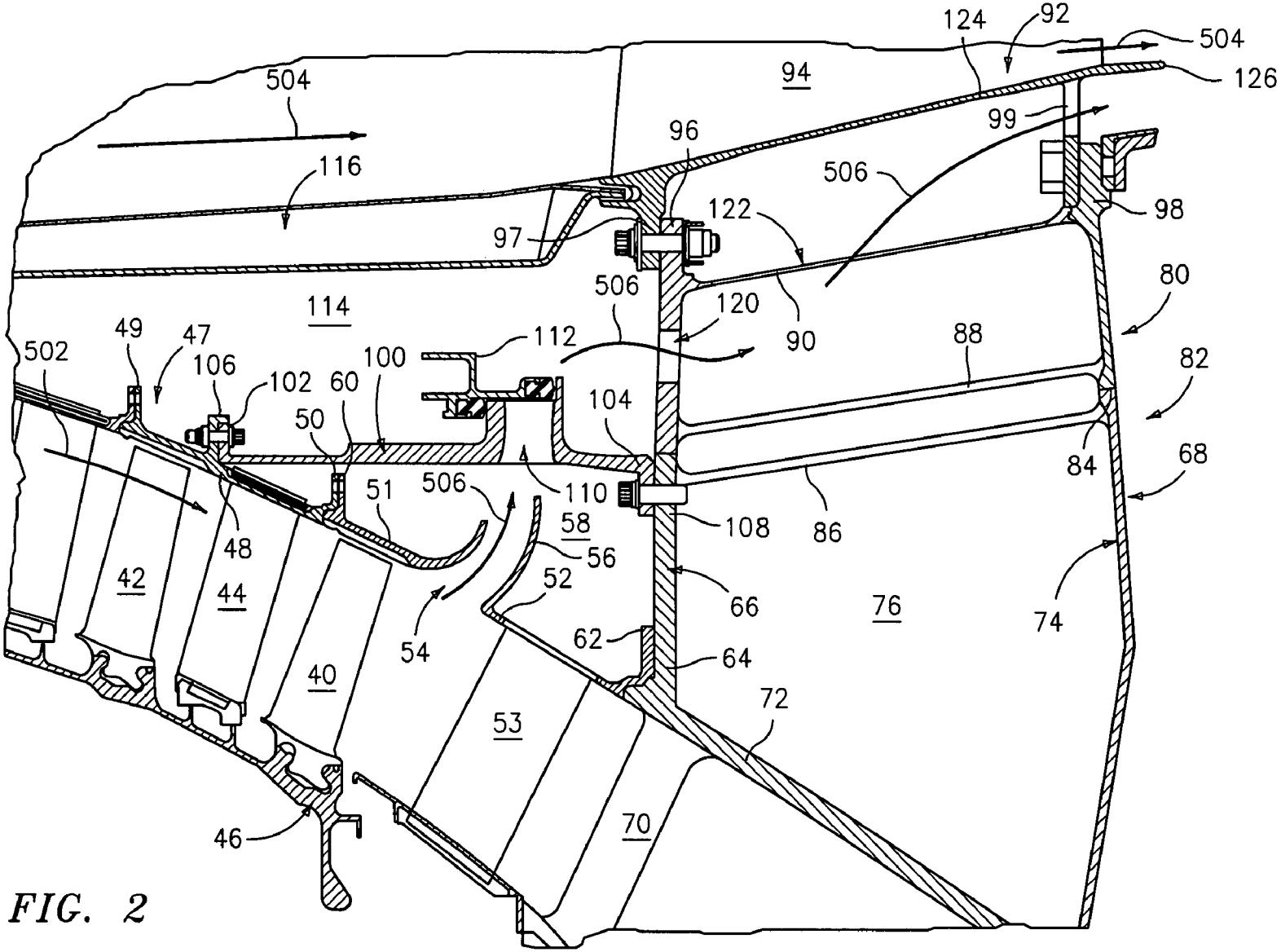
FIG. 2 is a partial longitudinal radial sectional view of a low speed/pressure compressor section of the engine of FIG. 1.

FIG. 2 shows details of the low speed/pressure compressor section 29. The section has a number of blade rows including a downstreammost last row of blades 40 and a penultimate row of blades 42 thereahead separated by a row of stator vanes 44. The blades' roots are mounted to one or more rotating disks 46 of the low speed spool. The vane outboard portions are mounted to associated shrouds.

A compressor shroud assembly 47 essentially provides the outboard boundary of the core flowpath 502. The assembly 47 includes a number of annular shrouds generally assembled end-to-end. Each of the shrouds may, itself, be segmented circumferentially, with the circumferential segments secured end-to-end. FIG. 2 shows a shroud 48 carrying the outboard end of the vanes 44. The exemplary shroud 48 has bolting flanges 49 and 50 for structurally bolting the shroud to similar flanges of shrouds immediately upstream and downstream thereof. The penultimate and last shrouds 51 and 52 downstream thereof combine to form an exit/bleed shroud. The shroud 52 is unitarily formed or alternatively integrated with a row of exit stator vanes 53 downstream of the last row of blades 40. Exemplary shrouds 51 and 52 may be a full annulus or may be split or segmented for assembly/manufacturing ease. The shrouds 51 and 52 combine to define a circumferential array of bleed ports 54 with bleed offtake ducts 56 extending outboard therefrom into a common annular bleed plenum 58. A downstream/trailing portion of the shroud 51 defines leading portions of the ducts 56 and an upstream leading portion of the shroud 52 defines trailing portions of the ducts 56.

The shroud 51 has an upstream bolting flange 60 mounted to the bolting flange 50 thereahead. The shroud 52 has a downstream bolting flange 62 mounted to an inboard upstream bolting flange 64 on a radial circumferential web 66 of a fan hub or rotor support frame 68 which forms a principal structural component of the engine. The fan hub 68 may be fabricated by welding together several circumferentially stacked pieces. In the illustrated embodiment, an inboard piece includes a circumferential array of struts 70 extending outboard to a shroud portion 72. Fore and aft circumferential webs 66 and 74 extend from the shroud portion 72 and are connected by longitudinal webs 76. An outboard piece 80 is joined to inboard piece 82 along a weld 84. The inboard piece has an outboard longitudinal circumferential web 86 and the outboard piece has inboard and outboard longitudinal circumferential webs 88 and 90. In the exemplary embodiment, the fore and aft radial circumferential webs 66 and 74 extend along both pieces and may alternatively be referenced as combined webs of the two pieces. For reference, certain areas of these webs identified as flanges may be thickened or otherwise reinforced although alternatively the term web may be used to identify the section of web material between the flanges.

At its outboard end, the outboard piece 80 is secured to root portions 92 of fan exit guide vanes 94 via fore and aft hub bolting flanges 96 and 98 and corresponding fore and aft vane bolting flanges 97 and 99.

A structural case 100 has an inboard surface defining an outboard extreme of the bleed plenum 58. The structural case 100 extends from a forward/upstream bolting flange 102 to an aft/downstream bolting flange 104. The upstream bolting flange 102 is mounted to an intermediate bolting flange 106 of the shroud 48. The downstream bolting flange 104 is mounted to a bolting flange 108 on the web 66 outboard of the web 74 and just inboard of the weld 84. The structural case 100 has a plurality of apertures 110 which may be selectively blocked by an annular valve element 112. The valve element 112 may be shiftable between open and closed conditions (the closed condition being shown) respectively exposing and blocking the apertures or ports 110 via a combined rotation and longitudinal translation as in the aforementioned '987 patent and may be provided with an appropriate actuator (not shown) to effect movement between such conditions.

A bleed flowpath 506 extends through the bleed port 54 and duct 56 into the bleed plenum 58. With the valve element 112 in its open condition, the bleed flowpath further continues through the apertures 110 and into an outboard plenum 114. The outboard plenum is generally bounded by the structural case 100 and shroud assembly 47 thereahead on the inboard side, the web 66 along the outboard web piece 80 on the aft side, and a flow divider (splitter) 116 separating the outboard plenum from the bypass flowpath 504. Therefrom, the flowpath proceeds through a port or window 120 in the forward web 66 along the outboard piece 80 of the structural hub 68. The flowpath proceeds through a window 122 in the outboard web 90. The flowpath may then pass between aft bolting flanges 99 of adjacent exit guide vanes 94 inboard of their platforms 124 to, downstream of trailing edges 126 of such platforms, and merge with the bypass flowpath 504.

The use of a structural case having the valve ports 110 (as opposed to placing the valve ports in a totally separate non-structural member) may facilitate an advantageous assembly process. The exist guide vanes may be preassembled to the structural hub. The last shroud 52 may then be bolted to the hub. The structural case may then be bolted to the hub. The shrouds 51 and 48 may be preassembled as may be the shrouds thereahead. This shroud subassembly may then be assembled to the structural case with the process including an insertion of the shroud 51 and a portion of the shroud 48 within the structural case followed by securing with bolts. The valve element (or elements) 112 may have been preassembled with the structural case or may be assembled after assembly of the case to the hub or after assembly of the shroud subassembly to the case. Thereafter the splitter may be installed.

One or more embodiments of the present invention have been described. Nevertheless, it will be understood that various modifications may be made without departing from the spirit and scope of the invention. For example, the principles may be applied as a modification of a preexisting engine configuration. In such a situation, details of the preexisting configuration would influence details of the particular implementation. Accordingly, other embodiments are within the scope of the following claims.

What is claimed is:

1. A gas turbine engine comprising:

a fan;

a compressor along a core flow path and having:

a plurality of rows of blades;

a plurality of rows of vanes; and a plurality of shroud rings, at least a bleed one of which defines a plurality of bleed ports;

a structural hub downstream of the shroud rings and secured relative to the shroud rings;

a structural case extending from an aft joint with the structural hub to a fore joint with a joined one of the shroud rings and having a plurality of valve ports, at least a portion of the structural case extending structurally between the fore and aft joints, wherein:

a bleed flowpath through the bleed ports and the valve ports further extends through the structural hub to join a fan bypass flow;

a valve element shiftable between:

a first condition in which the valve element blocks communication through the valve ports; and a second condition in which the valve element does not block said communication.

2. The engine of claim 1 wherein:

the structural hub contains at least one fan exit guide vane; and the bleed flowpath joins the fan bypass flow downstream of said fan exit guide vane.

3. A method for assembling a gas turbine engine, the engine comprising:

a fan;

a compressor along a core flow path and having:

a plurality of rows of blades;

a plurality of rows of vanes; and a plurality of shroud rings, at least a bleed one of which has a plurality of bleed ports;

a structural hub downstream of the shroud rings and secured relative to the shroud rings;

a structural case extending from an aft joint with the structural hub to a fore joint with a joined one of the shroud rings and having a plurality of valve ports;

a valve element shiftable between:

a first condition in which the valve element blocks communication through the valve ports; and a second condition in which the valve element does not block said communication, the method comprising:

assembling an exit guide vane assembly including an aftmost of said plurality of shroud rings to said structural hub;

assembling the structural case to the structural hub;

assembling an assembly of said shroud rings to the structural case with at least one of the shroud rings being at least partially inserted within the structural case.

4. The method of claim 3 wherein:

at least one fan exit guide vane is preassembled with the structural hub.

5. The method of claim 3 wherein:

the aftmost of said plurality of shroud rings has a plurality of duct portions associated with aft portions of said plurality of bleed ports; and the at least one of the shroud rings includes a penultimate shroud ring having a plurality of duct portions associated with fore portions of said plurality of bleed ports.

6. The method of claim 3 further comprising:

assembling the valve element to the structural case after assembling the structural case to the structural hub.

7. A gas turbine engine comprising:

a fan;

a compressor along a core flow path and having:

plurality of rows of blades;

a plurality arrows of vanes; and a plurality of shroud rings, at least a bleed one of which defines a plurality of bleed ports to a bleed plenum;

a structural hub downstream of the shroud rings and secured relative to the shroud rings;

a structural case extending from an aft joint with the structural hub to a fore joint with a joined one of the shroud rings and having a plurality of valve ports from the bleed plenum, at least a portion of the structural case extending structurally between the fore and aft joints, wherein:

the fore joint is a bolted joint securing the structural case to the joined one of the shroud rings; and the aft joint is a bolted joint securing the structural case to the structural hub; and a valve element shiftable between:

a first condition in which the valve element blocks communication through the valve ports; and a second condition in which the valve element does not block said communication.

8. The engine of claim 7 wherein:

the bleed plenum is an annular plenum.

9. A gas turbine engine comprising:

a fan;

a compressor along a core flow path and having:

a plurality of rows of blades;

a plurality of rows of vanes; and a plurality of shroud rings, at least a bleed one of which has a plurality of bleed ports to a bleed plenum;

a structural hub downstream of the shroud rings and secured relative to the shroud rings;

a structural case extending from an aft joint with the structural hub to a fore joint with a joined one of the shroud rings and having a plurality of valve ports from the bleed plenum, at least a portion of the structural case extending as a continuous piece between the fore and aft joints, wherein:

the fore joint is a bolted joint securing the structural case to the joined one of the shroud rings; and the aft joint is a bolted joint securing the structural case to the structural hub; and a valve element shiftable between:

a first condition in which the valve element blocks communication through the valve ports; and a second condition in which the valve element does not block said communication.

10. The engine of claim 9 wherein:

the joined one of the shroud rings is immediately upstream of the bleed one of the shroud rings.

11. The engine of claim 9 wherein:

the structural hub carries a plurality of fan exit guide vanes.

12. The engine of claim 9 wherein:

the bleed plenum is an annular plenum.

13. A gas turbine engine comprising:

a fan;

a compressor along a core flow path and having:

a plurality of rows of blades;

a plurality of rows of vanes; and a plurality of shroud rings, at least a bleed one of which defines a plurality of bleed ports;

a structural hub downstream of the shroud rings and secured relative to the shroud rings;

a structural case extending from an aft joint with the structural hub to a fore joint with a joined one of the shroud rings and having a plurality of valve ports, at least a portion of the structural case extending structurally between the fore and aft joints, the joined one of the shroud rings not being the bleed one of the shroud rings; and a valve element shiftable between:

a first condition in which the valve element blocks communication through the valve ports; and a second condition in which the valve element does not block said communication.

14. The engine of claim 13 wherein:

the valve element is so shiftable via a combined circumferential rotation and longitudinal translation.

15. The engine of claim 13 wherein:

the valve element carries an outboard aft seal and an inboard fore seal for sealing with the structural case in the first condition.

16. The engine of claim 13 wherein:

the fore joint is a bolted joint and the aft joint is a bolted joint.

17. The engine of claim 13 wherein:

the joined one of the shroud rings is immediately upstream of the bleed one of the shroud rings.

18. A gas turbine engine comprising:

a fan;

a compressor along a core flow path and having:

a plurality of rows of blades;

a plurality of rows of vanes; and a plurality of shroud rings, at least a bleed one of which has a plurality of bleed ports;

a structural hub downstream of the shroud rings and secured relative to the shroud rings;

a structural case extending from an aft joint with the structural hub to a fore joint with a joined one of the shroud rings and having a plurality of valve ports, at least a portion of the structural case extending as a continuous piece between the fore and all joints, the joined one of the shroud rings is immediately upstream of the bleed one of the shroud rings; and a valve element shiftable between:

a first condition in which the valve element blocks communication through the valve ports; and a second condition in which the valve element does not block said communication.

19. A gas turbine engine comprising:

a fan;

a compressor along a core flow path and having:

a plurality of rows of blades;

a plurality o f rows of vanes; and a plurality of shroud rings, at least a bleed one of which defines a plurality of bleed ports and comprises:

a shroud ring of an exit guide vane assembly having a plurality of duct portions associated with aft portions of said plurality of bleed ports; and a bleed duct having a plurality of duct portions associated with fore portions of said plurality of bleed ports;

a structural hub downstream of the shroud rings and secured relative to the shroud rings;

a structural case extending from an aft joint with the structural hub to a fore joint with a joined one of the shroud rings and having a plurality of valve ports, at least a portion of the structural case extending structurally between the fore and aft joints; and a valve element shiftable between:

a first condition in which the valve element blocks communication through the valve ports; and a second condition in which the valve element does not block said communication.

* * * * *

UNITED STATES PATENT AND TRADEMARK OFFICE

CERTIFICATE OF CORRECTION

PATENT NO. : 7,249,929 B2
APPLICATION NO. : 10/713641
DATED : July 31, 2007
INVENTOR(S) : Kevin J. Cummings et al.

It is certified that error appears in the above-identified patent and that said Letters Patent is hereby corrected as shown below:

In column 5, line 60, before “plurality” insert --a--.

In column 7, line 30, delete “all” and insert --aft--.

Signed and Sealed this

Twenty-fifth Day of December, 2007

JON W. DUDAS
*Director of the United States Patent and Trademark Office*